US008371887B2

(12) United States Patent
Anderson et al.

(10) Patent No.: US 8,371,887 B2
(45) Date of Patent: Feb. 12, 2013

(54) SURF AND RODEO AQUATIC ENTERTAINING BALL DEVICE

(76) Inventors: Anton D Anderson, Indianapolis, IN (US); Anthony W. Anderson, Indianapolis, IN (US)

( * ) Notice: Subject to any disclaimer, the term of this patent is extended or adjusted under 35 U.S.C. 154(b) by 72 days.

(21) Appl. No.: 12/760,533

(22) Filed: Apr. 14, 2010

(65) Prior Publication Data

US 2010/0273374 A1 Oct. 28, 2010

Related U.S. Application Data

(60) Provisional application No. 61/172,743, filed on Apr. 26, 2009.

(51) Int. Cl.
*B63B 35/73* (2006.01)

(52) U.S. Cl. ..... 441/129; 114/345

(58) Field of Classification Search ..... 441/129, 441/130, 131, 132, 40, 65, 66, 67, 28, 29; 114/345

See application file for complete search history.

(56) References Cited

U.S. PATENT DOCUMENTS

| | | | | |
|---|---|---|---|---|
| 3,427,022 | A | 2/1969 | Ward | |
| 5,320,568 | A * | 6/1994 | Koerkel, Jr. | 441/129 |
| 5,460,113 | A * | 10/1995 | Gunter | 441/129 |
| 5,713,773 | A * | 2/1998 | Churchill | 441/66 |
| 6,475,048 | B2 * | 11/2002 | Gredy | 441/129 |
| 6,872,117 | B1 | 3/2005 | Chen | |
| 7,044,820 | B2 | 5/2006 | Ladisa | |
| 7,232,356 | B2 * | 6/2007 | Hendrickson | 441/129 |
| 7,238,073 | B2 * | 7/2007 | Hendrickson | 441/129 |
| 7,867,049 | B1 * | 1/2011 | Doffay | 441/129 |

* cited by examiner

*Primary Examiner* — Lars A Olson
(74) *Attorney, Agent, or Firm* — KB Patents; Luca D'Ottone

(57) ABSTRACT

The surf and rodeo ball of the present application comprises a lower semi spherical body having an outer surface sufficient to define a volume for displacing enough water to support the apparatus itself and one or more persons riding it. The surf and rodeo ball of the present application also comprises a higher portion comprising a rope, a rope hook ring, a rope hook, for each of the hands of the user and a central elevated structure to accommodate and support the user's body. In addition to providing the amusement and exercise device, the ball has uses as a floating safety device.

15 Claims, 2 Drawing Sheets

SURF AND RODEO AQUATIC ENTERTAINING BALL DEVICE

CLAIM OF PRIORITY

The present application claims priority from U.S. provisional Application 61/172,743 filed on Apr. 26, 2009, directed to a Surf and Rodeo Ball that is incorporated by reference in this non provisional utility application.

FIELD OF THE INVENTION

The present invention is directed to balls with gripping handles. More particularly, the present invention is directed to balls with gripping handles that are used for recreational purposes as well as for floating device usable in emergency situations.

BACKGROUND OF THE INVENTION

Balls of different shape and colors are used as entertainment devices and as sport tools in different fields. Soccer, volleyball, and basketball are three typical sports that involve the use of a ball. Bull riding is a commonly known entertainment that finds different embodiments such as bull riding in stadium and country ranches or in bars on mechanical devices simulating the movements of a bull.

The present invention teaches a riding devices to be used on a water surface such as sea, ocean, lake, stream, or rapids depending on the particular requirements of the user. Said riding device is designed to float over said water surface by displacing a sufficient volume of water, while still allowing the titling and bending movements because of its semi spherical shape.

Various prior art devices are directed to apparatuses relevant to the one disclosed in the present application. For example U.S. Pat. No. 7,044,820 to Ladisa discloses and claims a ball comprises a body having an outer surface of sufficient extent to define a volume sufficient to accommodate at least a portion of each of four fingers of a person's hand. Under the teachings of the Ladisa patent said ball has at least one indentation in the surface, the indentation having a depth sufficient to receive at least a portion of four fingers. Furthermore according to the Ladisa patent each indentation is provided with a gripping surface against which the fingers press while other surfaces of the fingers or the hand engage the outer surface of the ball.

In addition to that U.S. Pat. No. 6,872,117 to Ming Chang-Cheng discloses and claims a bottom base for a soft water-spouting toy includes an upper combining base and a lower fixing base threadably combined with each other. According to the Chang-Cheng patent the fixing base is fixed stably on a handle or a child's bicycle, and the combining base is combined tightly with the lower portion of a soft water-spouting toy. Furthermore the Chang-Cheng patent discloses that said combining base has a center hole for a ball to sink therein, invertible with the toy for pouring water therethrough and into the interior of the toy after disengaged from the fixing base.

U.S. Pat. No. D552,696 to Hallar discloses and claims a new ornamental design for an exercise ball with handles to be used in the water. U.S. Pat. No. 5,106,078 to Rowe discloses and claims an aquatic exercising device/apparatus comprising a bed mounted on a frame supported by hollowed columns, and lines extending through such columns, their one ends attached to floats and their other ends attached to members for or applied to the hands and feet of its user.

Other prior art devices are directed to utensils and devices of similar functionality but no one discloses, claims, or makes reference to a device that combines the thrill of riding a bull with the fun of playing in the water.

SUMMARY OF THE INVENTION

In view of the aforementioned considerations, the present invention is directed to floating ball or semi-spherical device provided with hooks, holding ropes, foot grips, tools and handles that provide gripping surfaces for the user.

According to the teaching of the present invention said ball comprises a base having an outer surface of sufficient extent to displace enough water for allowing the device itself to float and for allowing one or more users to float on it.

According a further aspect of the present invention materials used are vinyl and plastic. Specifically the surf and water rodeo ball of the present invention has been designed in two alternative sizes respectively for children and adult. Other possible materials for the surf and rodeo ball of the present application are vinyl and plastic glue although alternative material can be employed for its manufacture.

Due to the floating requirements of said lower portion in one of the preferred embodiments of the present invention coating is applied for weather proofing and for facilitating cleaning. Considering the application of the invention and the environment of application, cleaning for constant reuse would is a major consideration for construction due to the potential incrustation of algae, mollusks, crustacean, bivalves, that can form and thrive on the submerged portion of said semi spherical base. Under the teaching of the present invention the proper ingredient of a coat or stain would allow for extended life and reduce factors such as rust decomposition, fraying and staining.

In one of the preferred embodiments of the present invention current technology such as polycoating or polycation is utilized to allow for extending use and continue environments that consist of heat, air, water, oil and other particles that cause deterioration.

In a further aspect of the ball, the body has an inner wall surface defining a space which receives air to inflate the ball.

In still a further aspect of the ball, there are a plurality of gripping devices on the superior higher portion of the surf and rodeo ball of the present invention. Said devices include ropes, ropes hooks, riding ropes hooks, and foot grips.

In still a further aspect of the invention, the lower portion of the ball displaces a mass of water equal or higher to the mass of the ball wherein the ball floats on water and is useful as a safety floatation device.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein:

FIG. 2(*b*) is a lateral perspective view of one the preferred embodiments of the surf and rodeo aquatic entertaining ball device of the present invention without the superior base member when in use;

DESCRIPTION OF THE PREFERRED EMBODIMENTS

Figure 1:
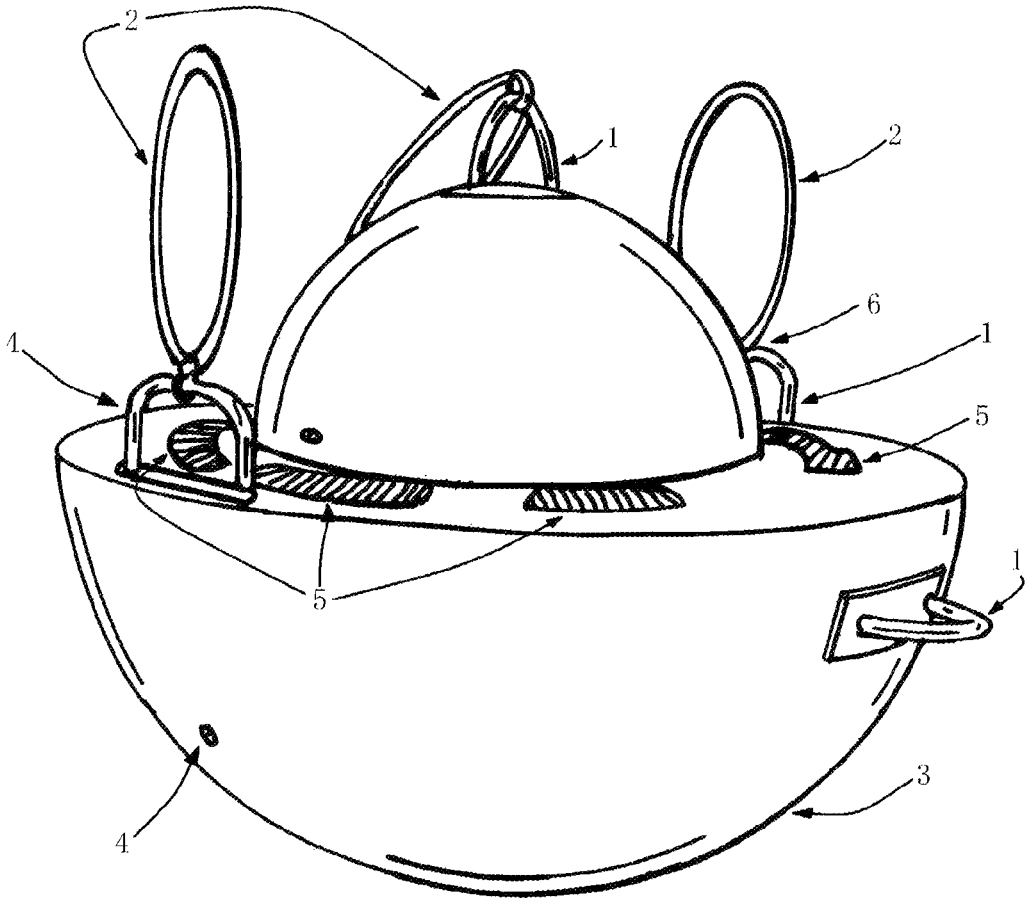
FIG. 1 is a front perspective view of one of the preferred embodiments of the surf and rodeo aquatic entertaining ball device of the present application.
Figure 2B:
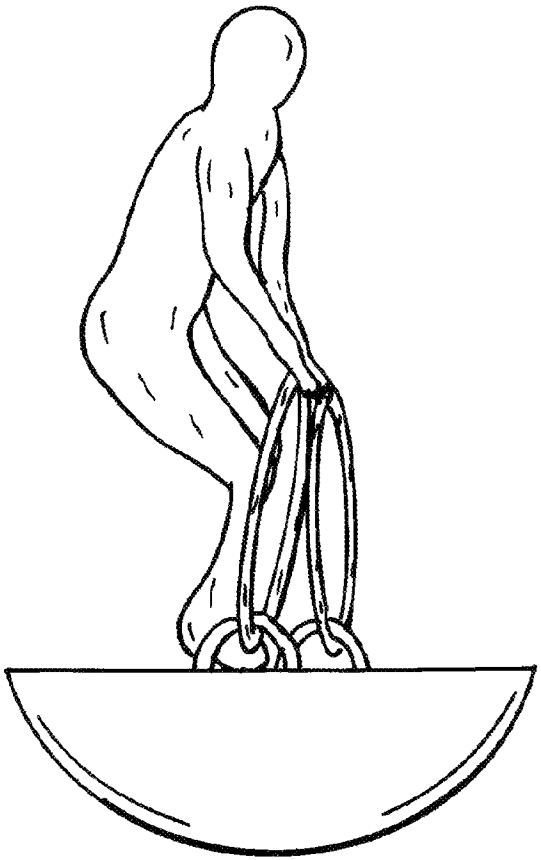
FIG. 2(*a*) is a front perspective view of the preferred embodiments of the surf and rodeo aquatic entertaining ball device of FIG. 1 when in use.
Figure 2A:
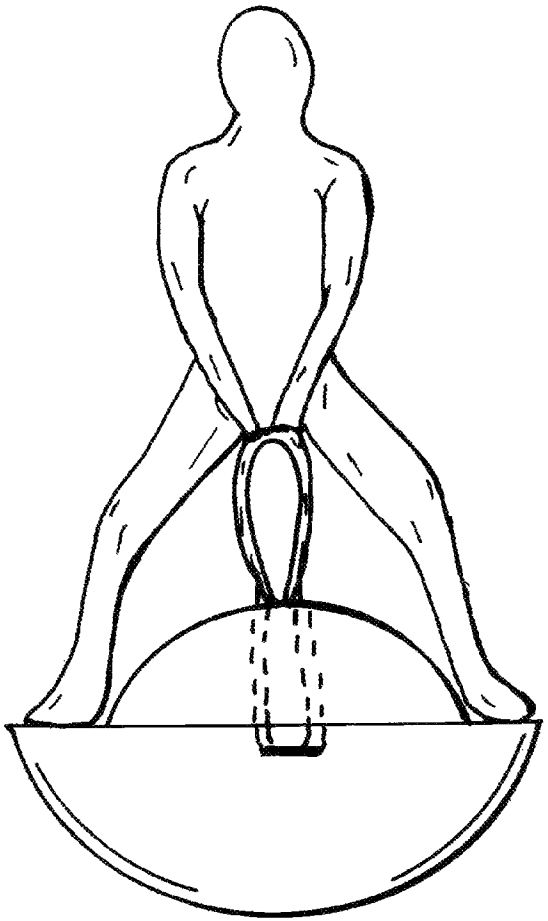

Referring now to FIGS. 1 and 2 there is a view of a semi spherical ball which may be used to play various games in the water or water sports. Said ball has a surface on which different ropes, grips, and gripping surfaces are provided. While some of these gripping aids are shown the number of them may be modified and optimized so to provide the best and safest combination of gripping aids to the user.

Under the teaching of the present invention the strength of said gripping tools and devices varies in accordance with the purposes of the ball being used but is always kept at a minimum to support and hold the mass of an adult human. FIG. 1 shows one of the preferred embodiments of the surf and rodeo aquatic entertaining ball device of the present invention with the detail of (1) the detachable rope hooks, (2) holding ropes, (3) semi spherical base member, (4) air valve, (5) foot grips, (6) superior base member.

For example in one of the preferred embodiments of the present invention indentations are provided as gripping aids. In order to provide a sufficient grip, the depth may be sufficient to receive up to three joints of a person's finger or may be shallower so as to receive just the end joint or the end joint plus the middle joints of a person's fingers. In a preferred embodiment, the person's thumb remains outside the indentation on the surface of the ball.

While FIG. 1 shows a semi spherical ball, supporting a higher portion used by the rider the surf and rodeo ball of the present application may have other shapes such as that of a football or an oblong shape to accommodate two or more people.

In one of the preferred embodiments the surf and rodeo ball of the present invention may additionally be of foam material throughout with a foam or may have an outer skin integrally formed therewith or molded therein. Said foam mass forming the ball may be of various degrees of stiffness so that the feel of the ball varies from being relatively soft to relatively stiff.

In still another embodiment of the invention, the surf and rodeo ball may be relatively soft, flexible and floppy with the hand holes therein so as to be suitable for impact games, such as but not limited to dodge ball.

While the various embodiments of the balls disclosed so far are useful for playing games, these balls may also be useful as flotation devices for people who have fallen from boats or piers or for some reason find themselves in relatively deep water. When used in the function as an emergency floating device they can be thrown with relative accuracy so that the sinking man can grip one or more of the various handles, grips, and ropes to keep themselves afloat.

In one preferred embodiment of the present invention the surf and rodeo ball is inflatable. In this preferred embodiments either a tubular mouth piece is provided, or the ball may be inflated by a gas cartridge such as carbon dioxide, helium, hydrogen, propane or other suitable gas cartridge. Or both solutions may be provided one being the alternative of the other one.

The aforementioned configurations provide balls with surfaces having grips, ropes, hooks, and indentations so that the balls may be readily gripped allowing a person to positively hold a ball with one hand and eventually riding it onto waves. The user can choose to ride the device of the present application in a beach context, on a lake, wetlands, in river and rapids or in any other different water surface.

The balls according to the present invention may be of any size, shape or color and the material or the balls may be rubber, plastic, fabric leather or any other suitable material. The number of handles can be one or two or more and the ball can be used for any game for adults or children.

The handles enable ease of handling so that a handicapped person or young child may readily use the ball with one hand. In other words, the handles in the ball allow easier use of the ball for those with less ability to hold a round object, especially with one hand (disabled individual, young children just learning to grasp, etc.)

Moreover, with handles imbedded in a ball it can be held by any of the handles or grasped on the exterior like other ball. The ball with handles is an improvement on balls without handles. The balls previously described are used in the same way as current balls, only the added feature of handles makes the balls of the present invention easier to grasp and more accessible to use, as well as more versatile to throw.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A floating device for use in aquatic entertaining comprising a bottom semi spherical base member (3) and a superior semi spherical base member (6) having same of shorter diameter of said bottom semi spherical base member, both members being coaxially affixed to each other, the bottom member having: a plurality of foot grips(5) horizontally placed in an annular surface in between said two semi spherical base members, an air valve (4) on a lower bottom part of its semi spherical surface, a plurality of rope hooks (1) affixed in sets of diametrically opposing pairs on its outside semi spherical surface, and a plurality of rope hooks (1) affixed in sets of diametrically opposing pairs on said annular surface in between said two semi spherical base members; the superior member having: at least one rope hook (1) on its top.

2. The floating device for use in aquatic entertaining of claim 1 where said superior semi spherical base member further comprises a plurality of indentations sufficiently deep to receive up to three joints of a user's fingers.

3. The floating device for use in aquatic entertaining of claim 2 where said indentations can accommodate the user's thumb in their outside.

4. The floating device for use in aquatic entertaining of claim 1 where said bottom semi spherical base member further comprises a plurality of indentations sufficiently deep to receive up to three joints of a user's fingers.

5. The floating device for use in aquatic entertaining of claim 4 where said indentations can accommodate the user's thumb in their outside.

6. The floating device for use in aquatic entertaining of claim 1 where said bottom semi spherical base member is entirely made by floating stiff foam.

7. The floating device for use in aquatic entertaining of claim 1 where said semi spherical superior base member is entirely made by floating fluffy foam.

8. The floating device for use in aquatic entertaining of claim 1 where a body resulting by the coaxial combination of said superior semi spherical base member and said bottom semi spherical base member, is coated to allow for extended use in harsh environments.

9. The floating device for use in aquatic entertaining of claim 1 where said coating material is constituted by polycations.

10. The floating device for use in aquatic entertaining of claim 1 where said semi spherical bottom base member is inflatable.

11. The floating device for use in aquatic entertaining of claim 10 where said air valve is a tubular mouth piece.

12. The floating device for use in aquatic entertaining of claim 10 further comprising a gas cartridge to inflate said first base member.

13. The floating device for use in aquatic entertaining of claim 12 where said gas is selected from the group consisting of Carbon Dioxide, Helium, Hydrogen, or Propane.

14. The floating device for use in aquatic entertaining of claim 1 further comprising a plurality of holding ropes (2) attached to said rope hooks.

15. The floating device for use in aquatic entertaining of claim 1 where said rope hooks are detacheable.

* * * * *